United States Patent [19]

Kamar

[11] 4,296,567

[45] Oct. 27, 1981

[54] FIGURE TOY WITH FLEXIBLE APPENDAGES

[75] Inventor: Pascal M. Kamar, Palos Verdes Estates, Calif.

[73] Assignee: Kamar International, Inc., Torrance, Calif.

[21] Appl. No.: 142,786

[22] Filed: Apr. 22, 1980

[51] Int. Cl.[3] ..... A63H 3/46

[52] U.S. Cl. ..... 46/163; 46/151; 46/158; 46/131

[58] Field of Search ..... 46/151, 152, 153, 156–163, 46/123, 131

[56] References Cited

U.S. PATENT DOCUMENTS

| | | | |
|---|---|---|---|
| D. 147388 | 8/1947 | Wahrer | 46/153 UX |
| 1,336,898 | 4/1920 | Flynn | 46/151 |
| 1,355,799 | 10/1920 | Bradish | 46/160 |
| 1,388,677 | 8/1921 | Weatherly | 46/158 |
| 1,710,989 | 4/1929 | Kelly | 46/151 |
| 2,997,810 | 8/1961 | Bellas | 46/158 |
| 3,851,419 | 12/1974 | Kaelin | 46/158 X |
| 3,885,342 | 5/1975 | Morrison et al. | 46/158 X |

*Primary Examiner*—Gene Mancene
*Assistant Examiner*—Mickey Yu
*Attorney, Agent, or Firm*—Herzig & Walsh, Inc.

[57] ABSTRACT

A figure toy constructed to simulate a living creature, such as an animal. In a preferred form the figure toy has a torso and flexible appendages simulating arms and legs. The appendages are of flexible material with ends which are weighted, preferably being in the form of envelopes containing relatively heavier comminuted material. The appendages may resemble arms and legs. Because of their flexibility and end sections the toy can be suspended in many different positions by way of its appendages with the end sections being placed on or over a surface. The toy is susceptible of being manipulated into contortions and in this respect having extraordinary versatility and resultant play value.

6 Claims, 8 Drawing Figures

FIGURE TOY WITH FLEXIBLE APPENDAGES

BACKGROUND OF THE INVENTION

1. Field of the Invention

The field of the invention is that of figure toys or dolls and particularly toys of this type having manipulatable appendages particularly ones that simulate arms and/or legs of a living creature.

2. Description of the Prior Art

Many and various types of figure toys and dolls are known in the prior art including figure toys with articulated arms and legs. However, with respect to such items as known in the prior art, none have the unique characteristics and versatility with respect to contortion and the like as the herein invention, a preferred form of which is described in detail hereinafter.

SUMMARY OF THE INVENTION

In a preferred exemplary form of the invention, the figure toy takes a form having a torso and head with appendages which are flexible including appendages resembling arms and appendages resembling legs.

Preferably the entire figure toy may be made of flexible fabric material, the torso part being filled with a light weight relatively soft spongy material which may be of various types.

The appendages, that is, the simulated arms and legs are relatively long and are flexible, preferably being made of a fabric material so that they can be wrapped over support members or the like or otherwise manipulated or contorted.

At the ends of each appendage is a construction having weight to provide a holding capability. The end section of each appendage may be in the form of a fabric envelope containing a comminuted material so that it is relatively soft and manipulatable but yet heavy enough to have the holding capability. As a result, the figure toy can be suspended by way of the sections at the ends of the appendages from the edge of a flat surface or from other support members with the figure toy taking a wide variety of contortionate positions. In this respect the toy possesses great versatility while at the same time being soft, pliable, easily manipulatable and still being adapted to relatively easy and economical fabrication.

In the light of the foregoing, a primary object of the invention is to realize a figure toy having unique capabilities in the way of manipulatability of its appendages and unique capability in the way of its being able to be suspended by way of one or more of its appendages.

A further object is to realize a figure toy as in the foregoing, having relatively long flexible appendages with end sections having weight so as to provide a holding capability by way of the said end sections.

A further object is to realize a toy as in the foregoing wherein the end sections are formed as envelopes of flexible fabric material filled with comminuted material or substance to provide weight.

Further objects and additional advantages of the invention will become apparent from the following detailed description and annexed drawings.

BRIEF DESCRIPTION OF THE PREFERRED EMBODIMENT AND BEST MODE OF PRACTICE OF THE INVENTION

Figure 1:
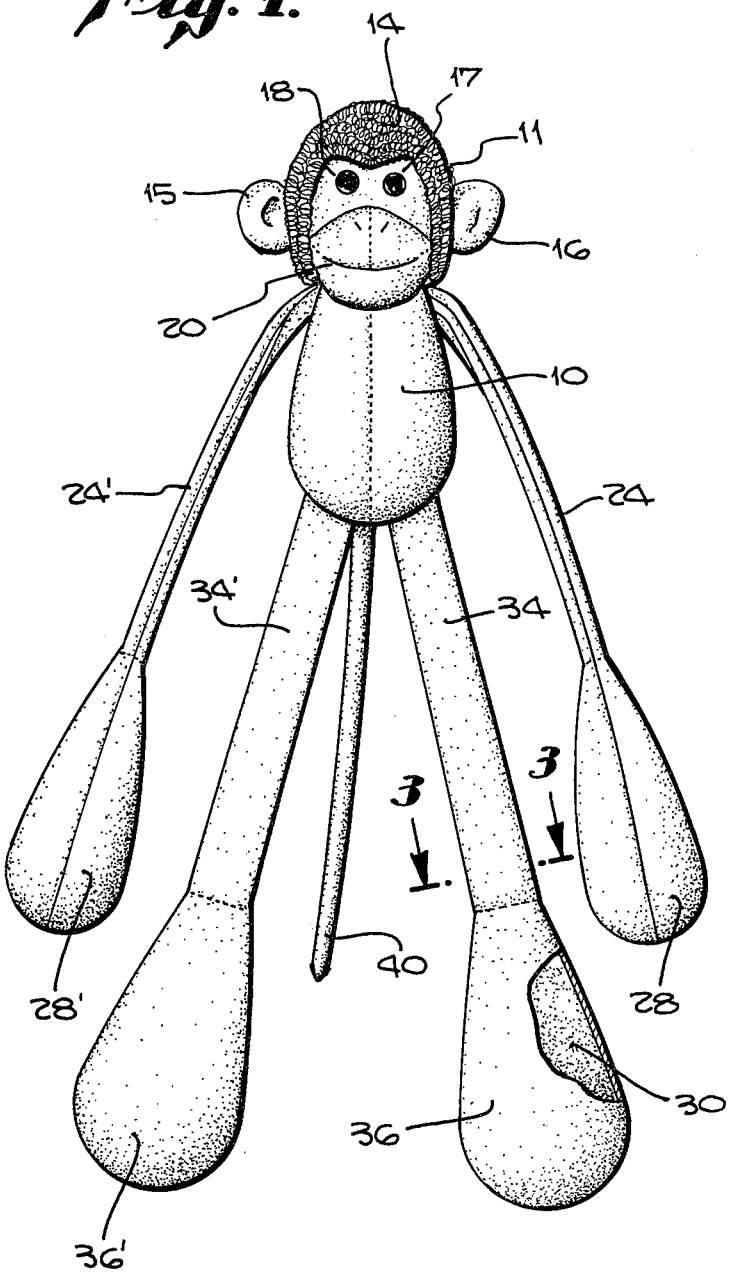
FIG. 1 is a front view of an exemplary form of the figure toy of the invention.
Figure 2:
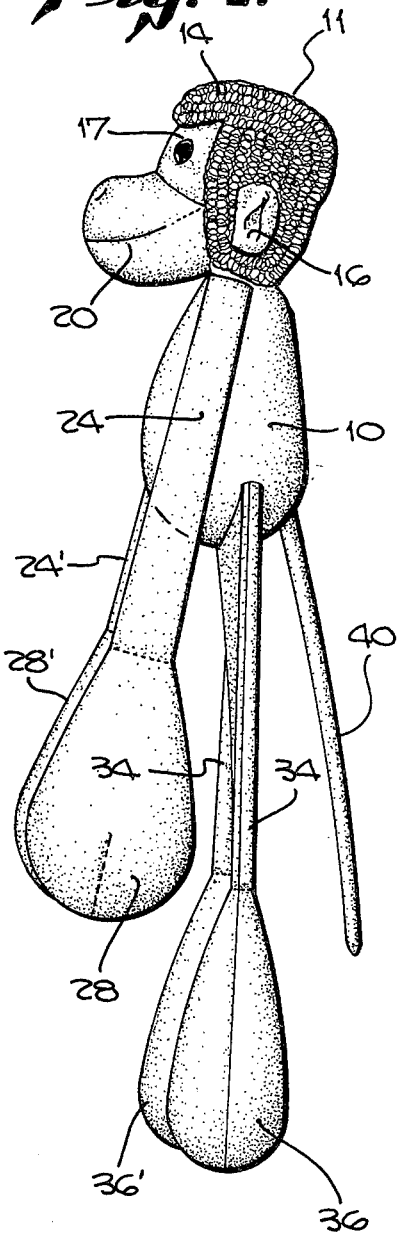
FIG. 2 is a side view of the figure toy of FIG. 1.
Figure 3:
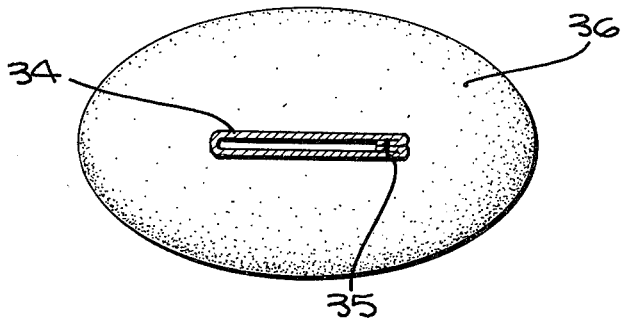
FIG. 3 is a sectional view taken along the line 3—3 of FIG. 1.

Referring to FIGS. 1, 2 and 3 of the drawings a preferred exemplary form of the figure toy as shown. In the exemplary form of the invention, the toy simulates an animal, in this form, a chimpanzee or monkey.

The body of the toy includes a torso 10 having a shape as shown. It may be fabricated using a skin of fabric material which may be seamed together or otherwise, and filled with a relatively soft spongy material which may be of various types having a soft spongy characteristic. The body includes a head 11 which may be similarly formed of fabric material having parts which may be seamed together, the fabric being any suitable relatively thin flexible type. In the form of the invention shown, the head has simulated hair 14 formed of any suitable material adapted to form artificial hair. Ears are provided as shown at 15 and 16 formed of the same fabric material sewn to the skin of the head. Eyes are provided as shown at 17 and 18 formed of glass and being of a type as ordinarilly used with dolls or the like. Simulated nostrils are formed as shown below the eyes, preferably simply by way of stitching of black thread or the like. A simulated mouth is provided as shown at 20 which may be made simply by way of a piece of colored thread such as red thread sewn or secured to the fabric of the head.

Appendages are provided as described in the foregoing. The appendages include arms 24 and 24' which are alike. Preferably, the arms are formed of a fabric material like the fabric material of the torso and head. In a preferred form the arms are simply tubular pieces of the fabric material with a lengthwise seam and then flattened to form the arm.

At the end of the arm 24 as shown, the material is widened out to form an envelope as illustrated at 28 which may be fabricated like the arms having a seam along one side and there may be a partial tranverse seam. Preferably the end envelope 28 has a shape as shown, being smooth and rounded. The envelope is filled with comminuted material as designated at 30, this being material of any of various types having weight, as described hereinafter. Preferably the material is a comminuted material so that the end section although weighted is relatively soft, the comminuted material of the type used in bean bags or the like may be utilized. A preferred form of the comminuted material used in the end sections is tumbled, crushed walnut shells. This is a product that is commercially available and is used for stuffing for animal or figure toys, bean bags, etc.

The arm 24' is like the arm 24 and need not be described in detail.

Numeral 34 designates another appendage which is a leg and numeral 34' designates another similar leg. The leg is formed from fabric material corresponding to the manner of fabrication of the arms. At the end of the leg 34 is an envelope 36 containing comminuted material 30 and constructed like the envelope 28 of arm 24. FIG. 3 shows a cross section of the leg 34 showing how the fabric at one side has the edges folded inwardly and then seamed as indicated at 35.

The leg 34' is like the leg 34 and therefore need not be described in detail.

Preferably the animal is provided with a tail as designated at 40. The tail is just a tubular piece of the same fabric material having a slight taper as shown and having a longitudinal seam like that described in connection with FIG. 3. The tail may be simply empty so that it is very flexible although of course it could be filled with soft spongy or comminuted material.

FIGS. 4–8 illustrate the capabilities of the toy and its unique versatility from the stand-point of simulation of contortions or gymnastic activities or the like.

Figure 4:
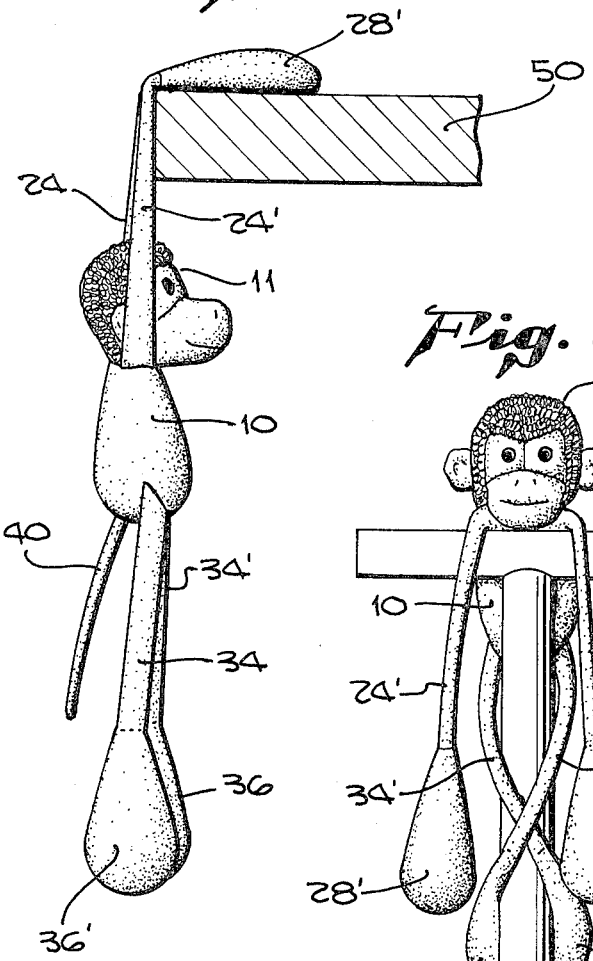
FIG. 4 is an illustrative view illustrating one of the capabilities of the figure toy being suspended by its simulated arms.

FIG. 4 shows the figure toy suspended from an edge of a support such as a table 50 with the end sections 28 and 28' on the table with the figure toy suspended from the flexible arms 24 and 24'.

Figure 5:
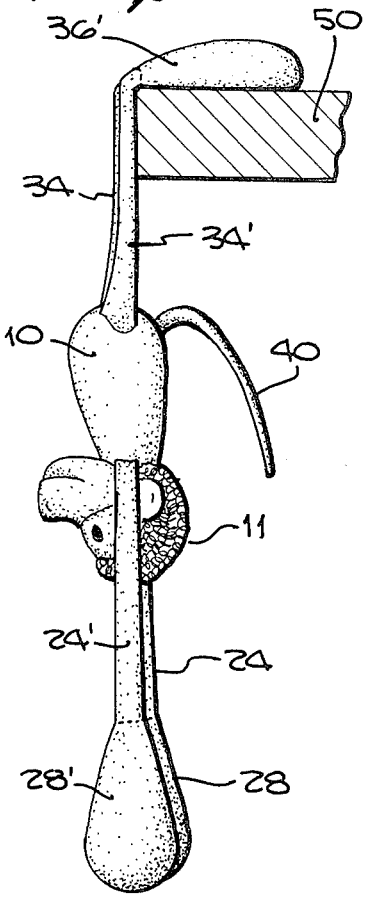
FIG. 5 is another illustrative view showing the figure toy being suspended by way of the sections at the ends of its simulated legs.

FIG. 5 shows the figure toy similarly suspended with its simulated feet 36 and 36' on the edge of the tabletop. As previously explained, the end sections which simulate the hands and feet have sufficient weight relative to the other parts of the figure toy so as to have the capability of suspending as shown in FIGS. 4 and 5.

Figure 6:
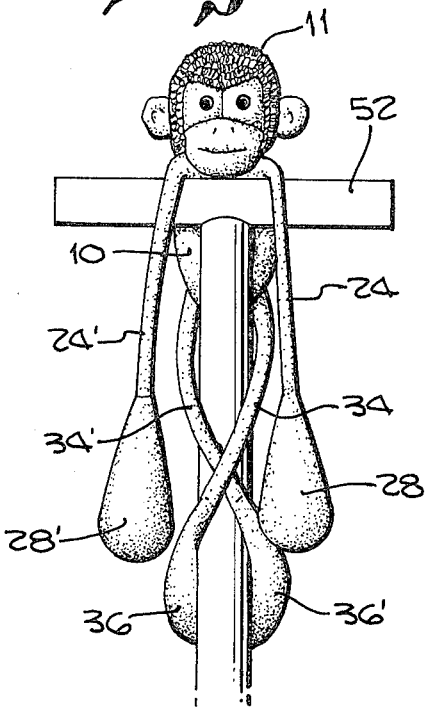
FIG. 6 is an illustrative view illustrating the manipulatability of the figure toy relative to a T-shaped support device.

FIG. 6 shows the figure toy hanging over a T-bar with its legs wrapped around the upright of the T-bar. This illustrates the flexibility and manipulatability of the toy whereby it has the capability and characteristic of simulating contortions or gymnastic movements and positions.

Figure 7:
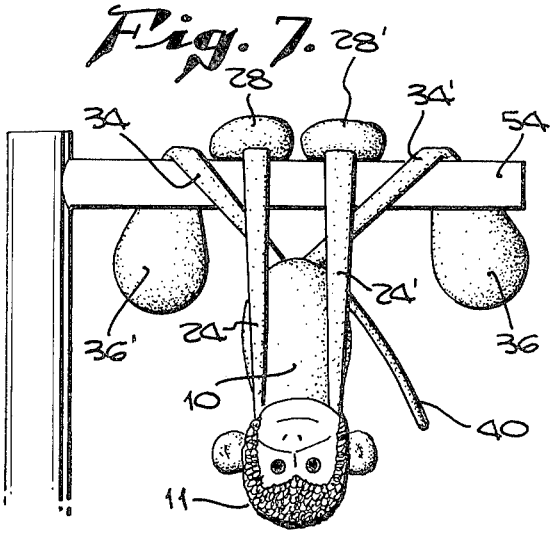
FIG. 7 is another illustrative view illustrating the manipulatability of the figure toy relative to a horizontal support bar.

FIG. 7 shows the figure toy in another position suspended by all four appendages from a horizontal bar 54 extending from an upright 56. The legs 24 and 24' are separated and are hung over the bar 54, the weighted end sections 36 and 36' holding the legs in this position. The end sections 28 and 28' resembling the hands at the ends of the arms are on or over the bar 54 simulating the body being suspended in part by the arms 24 and 24'.

Figure 8:
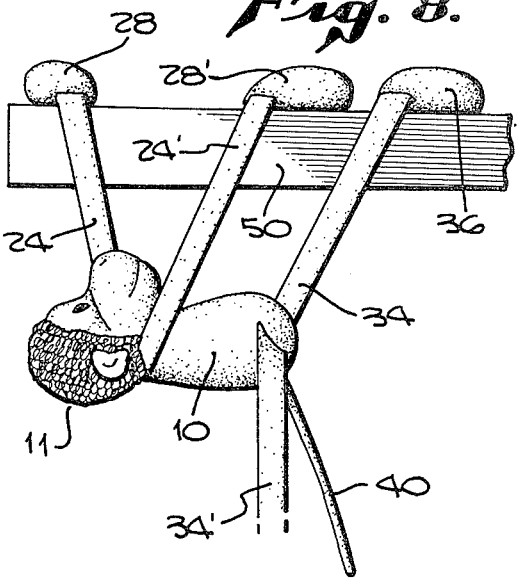
FIG. 8 is another view illustrating the manipulatability and suspension cabability of the toy relative to the surface of a support member.

FIG. 8 is illustrative of another manipulated position of the figure toy in which the end sections of the arms 28 and 28' are on the surface of the member 50 and the end section 36 at the end of one of the legs is on this surface so that the figure toy is suspended by the two arms and one leg.

From the foregoing, it will be of course, understood that the figure toy can be manipulated into innumerable if not an infinite number of configurations and positions of which FIGS. 4–8 are illustrative. This characteristic of the figure toy is extremely versatile from the standpoint of manipulatability and the capability of the figure toy of simulating contortions. Its capability of suspending itself by way of its simulated hands and/or feet in various positions is exemplary of its unique versatility in this respect. Because of these capabilities of the figure toy as described, its play value to a child is vastly increased, since the things that can be done with the toy are limited only by the child's imagination as to what is done with it.

From the foregoing, those skilled in the art will readily understand and appreciate the nature and characteristics of the toy and the manner in which it achieves the objectives as set forth in the foregoing.

The foregoing disclosure is representative of a preferred form of the invention and is to be interpreted in an illustrative rather than a limiting sense, the invention to be accorded the full scope of the claims appended hereto. It is to be understood that it is intended that the claims shall cover a full range of equivalents and further that the claims shall cover figure toys and the like constructed so as to have the unique characteristics and capabilities as exemplified in the herein disclosure. Many forms of life can be simulated in the figure toy. It can of course be constructed of various materials which provide the necessary flexibility, particularly in the appendages. The holding function at the ends of the appendages, that is the arms and legs can be provided in alternative ways such as by having end sections simulating feet and hands wherein the holding capability is provided by other means that will readily hold and release.

What is claimed is:

1. A figure toy adapted for undergoing simulated contortions, comprising a body part, the body part having a plurality of appendages, such appendage including a flexible manipulatable portion and an end section, the said portion being between the body part and the end section, the said end section having a construction which is weighted whereby to have a holding capability whereby the toy can be supported or suspended from a surface by way of at least one of the appendages and its end section having engagement with the surface, said end section having sufficient weight to hold the toy suspended.

2. A figure toy as in claim 1 wherein each end section is in the form of a flexible envelope containing a comminuted material providing weight.

3. A figure toy as in claim 1 wherein said appendages include appendages constructed to simulate arms.

4. A figure toy as in claim 3 wherein said appendages include appendages constructed to simulate legs.

5. A figure toy as in claim 1 wherein the said body includes a head.

6. A figure toy as in claim 1 wherein the appendages and their end sections are formed of a flexible fabric material.

* * * * *

UNITED STATES PATENT AND TRADEMARK OFFICE

CERTIFICATE OF CORRECTION

PATENT NO. : 4,296,567

DATED : October 27, 1981

INVENTOR(S) : Pascal M. Kamar

It is certified that error appears in the above-identified patent and that said Letters Patent is hereby corrected as shown below:

Column 4, line 37, claim 1, "such" should read -- each --.

Signed and Sealed this

*Ninth* Day of *November 1982*

[SEAL]

*Attest:*

GERALD J. MOSSINGHOFF

*Attesting Officer*

*Commissioner of Patents and Trademarks*